US006331510B1

(12) United States Patent
Curtis et al.

(10) Patent No.: US 6,331,510 B1
(45) Date of Patent: Dec. 18, 2001

(54) SYNTHETIC DIESEL ENGINE LUBRICANTS CONTAINING DISPERSANT-VISCOSITY MODIFIER AND FUNCTIONALIZED PHENOL DETERGENT

(75) Inventors: Thomas T. Curtis, Duffield; Gordon D. Lamb, Mickleover, both of (GB); William D. Abraham, South Euclid, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/782,127

(22) Filed: Feb. 13, 2001

(51) Int. Cl.[7] ..... C10M 129/10

(52) U.S. Cl. ..... 508/578; 508/579; 508/585; 508/587; 508/586

(58) Field of Search ..... 508/578, 579, 508/585, 586, 587

(56) References Cited

U.S. PATENT DOCUMENTS

| | | | | |
|---|---|---|---|---|
| 2,250,188 | | 7/1941 | Wilson | 252/39 |
| 2,647,873 | | 8/1953 | Matthews et al. | 252/42.7 |
| 4,627,928 | * | 12/1986 | Karn | 508/578 |
| 4,701,354 | * | 10/1987 | Kitamura et al. | 427/318 |
| 4,916,031 | * | 4/1990 | Kitamura et al. | 428/626 |
| 5,688,751 | * | 11/1997 | Cleveland et al. | 508/518 |
| 5,719,107 | | 2/1998 | Outten et al. | 508/185 |
| 6,103,672 | * | 8/2000 | Dunn et al. | 508/185 |

* cited by examiner

*Primary Examiner*—Jacqueline V. Howard
(74) *Attorney, Agent, or Firm*—David M. Shold; Michael F. Esposito

(57) ABSTRACT

A lubricant containing (a) a synthetic base oil composition having an overall kinematic viscosity of at least about $4.8\times10^{-6}$ $m^2/s$ (4.8 cSt) at 100° C. and a viscosity index of at least about 110; (b) a dispersant-viscosity modifier; and (c) a sulfur-free functionalized hydrocarbyl-substituted phenol detergent provides improved valve train wear, with longer drain intervals, to heavy duty diesel engines.

28 Claims, No Drawings

SYNTHETIC DIESEL ENGINE LUBRICANTS CONTAINING DISPERSANT-VISCOSITY MODIFIER AND FUNCTIONALIZED PHENOL DETERGENT

BACKGROUND OF THE INVENTION

The present invention relates to synthetic based lubricants which are particularly useful for lubricating heavy duty diesel engines.

Specifications for modern engine lubricants, such as those for heavy duty diesel engines, especially in Europe, indicate a longer interval between oil changes than has been customary in the past. In order to formulate engine oils with longer drain intervals, higher levels of certain additives have been incorported, typically greater than 1.7% by weight detergent substrate and greater than 10 TBN (Total Base Number, ASTM D2896) in the finished lubricant. Additionally, synthetic base stocks have been used to improve the thermo-oxidative stability of the base oils. These high levels of detergent soap substrate and TBN provide improved piston cleanliness and reduced engine wear over drain intervals which may be in excess of 100,000 km. However, the high level of detergent can cause higher levels of valve train wear, as measured in the Cummins M11 valve train wear test.

To address the problem of increased valve train wear, a heavy duty diesel lubricant has now been formulated using a selection of synthetic base oils, a dispersant-viscosity modifier, and a sulfur-free functionalized alkyl phenol detergent. The preferred lubricant also exhibits good emissions performance.

U.S. Pat. No. 5,719,107, Outten et al., Feb. 17, 1998, discloses a crankcase lubricant for diesel engines, comprising an admixture of a major amount of an oil of lubricating viscosity, at least 4 mass % dispersant, at least 0.3 mass % of a metal phenate, which may be neutral or overbased, and various other components. The oil can be any of the synthetic or natural oils, or mixtures. The oil has a viscosity of about 2.5 to about 12 $mm^2$/sec. Multifunctional viscosity modifiers that also function as dispersants are also disclosed. Suitable metal phenates include calcium, magnesium, and mixtures of the two.

U.S. Pat. No. 2,647,873, Matthews et al., Aug. 4, 1953. discloses compounds which are suitable as additional agents to lubricating oils and greases. Metal salts and condensates are prepared from the following ingredients: an aromatic compound containing a polar radical or radicals (e.g., phenols), and aldehydes such as formaldehyde. The Ca, Mg, Sr, Cu, Zn, Al, and Sn salts of certain of these condensation products are disclosed.

SUMMARY OF THE INVENTION

The present invention provides a lubricant suitable for use in a diesel engine, comprising:

(a) a synthetic base oil composition, said base oil overall having a kinematic viscosity of at least $4.8\times10^{-6}$ $m^2/s$ (4.8 cSt) at 100° C. and a viscosity index of at least 110;

(b) a dispersant-viscosity modifier; and (c) a sulfur-free functionalized hydrocarbyl (or alternatively, alkyl) phenol detergent.

The invention also provides a method for lubricating a crankcase-lubricated diesel engine comprising supplying such a lubricant to the crankcase thereof.

DETAILED DESCRIPTION OF THE INVENTION

Various preferred features and embodiments will be described below by way of non-limiting illustration.

The first component of the present lubricants is a selected synthetic base oil or mixture of base oils. Synthetic oils in general include hydrocarbon oils such as polymerized and interpolymerized olefins, e.g., polyalphaolefins (PAOs). Typically, polyalphaolefins are derived from monomers having from about 4 to about 30, or from about 4 to about 20, or from about 6 to about 16 carbon atoms. Typically, PAOs are hydrogenated. Examples of useful PAOs polybutylenes, polypropylenes, propylene-isobutylene copolymers, poly(1-hexenes, poly(1-octenes), poly(1-decenes), and mixtures thereof).

Alkylbenzenes are another species of synthetic hydrocarbon oil. Alkylbenzenes include generally $C_{10-13}$ alkyl-substituted benzenes, including dodecylbenzenes and bis-dodecylbenzenes such as m-bisdodecylbenzene; tetradecylbenzenes; dinonylbenzenes; and di(2-ethylhexyl)-benzenes;

Other species of synthetic hydrocarbon oils include polyphenyls (e.g., biphenyls, terphenyls, and alkylated polyphenyls), alkylated diphenyl ethers and alkylated diphenyl sulfides and the derivatives, analogs, and homologues thereof.

Group III base oils are also sometimes considered to be synthetic base oils, and for the purposes of this invention they can be considered to be included within the definition of "synthetic base oils." Group III base oils are defined by the API Base Oil Interchange Guidelines as having the following minimum characteristics: $\leqq$0.03% sulfur, $\geqq$90% saturates, and $\geqq$120 viscosity index. These are generally oils which are derived from natural stocks (as opposed to being derived from synthetic sources), but are so highly refined that they can exhibit the performance and viscosity parameters of other synthetic base oils.

Another class of synthetic base oils includes alkylene oxide polymers and interpolymers and derivatives thereof where the terminal hydroxyl groups have been modified by esterification, etherification, or similar reaction constitute. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1,000 diphenyl ether of polyethylene glycol having a molecular weight of 500–1,000, diethyl ether of polypropylene glycol having a molecular weight of 1,000–1,500) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils comprises synthetic esters, including the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, dodecanedioic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, and tripentaerythritol. Examples of synthetic monoester oils which are commercially available include Emery™ 2935, Emery™ 2971, Priolube™ 1976, Priolube™ 3999, Nycobase™ 8311, Nycobase™ 8885, and Nycobase™ 8886.

A useful synthetic base oil composition is selected from one or more polyalphaolefin oils, one or more synthetic esters, and one or more alkylbenzenes, or mixtures thereof. In one embodiment the base oil is a mixture of a polyalphaolefin oil having a viscosity of 4 to $8\times10^{-6}$ $m^2/s$ (4–8 cSt) at 100° C., alternatively in an amount of 60 to 95% by weight, a $C_{10-13}$ alkyl-substituted benzene, or in an amount of 5 to 20 percent by weight, and optionally a synthetic monoester, for instance, in an amount of 0 to 20 percent by weight.

The synthetic base oil composition used in the present lubricant should exhibit a kinematic viscosity (ASTM 445) of at least $4.8\times10^{-6}$ $m^2/s$ (4.8 cSt) at 100° C. and alternatively at least 5.0, 5.1 or 5.3, and optionally up to $7.0\times10^{-6}$ $m^2/s$ at 100° C. The base oil composition overall should also exhibit a viscosity index (ASTM 2270) of at least 110, such as at least 120, or in the range of 120 to 160. Viscosity Index or "V.I." is an arbitrary number which indicates the resistance of a lubricant to viscosity change with temperature. The Dean and Davis viscosity index calculated from the observed viscosities of a lubricant at 40° C. and 100° C. gives V.I. values ranging from 0 or negative values to values of 200 or more. The higher its V.I. value, the greater the resistance of a lubricant to thicken at low temperatures and thin out at high temperatures. These parameters are intended to apply the base oil composition as such, without the benefit of any viscosity index modifiers (which may, however, also be present).

Moreover, in one embodiment, most or all of the individual components of the synthetic base oil exhibit these same viscosity and viscosity index properties. Thus, any components of the oil which individually have a viscosity index of less than 120 can optionally comprise in total no more than 20 percent, and in one embodiment no more than 10 percent by weight of the base oil composition. Moreover, in one embodiment, at most a small portion of the overall base oil composition will comprise a natural (i.e., non-synthetic) oil. This option may be desired because natural oils generally do not exhibit the desirable viscosity or viscosity index properties. Therefore, the base oil composition can contain 1 to 25 percent by weight of natural base oil components, or less than 20 percent, or less than 10 percent, and in one embodiment can contain substantially no natural base oil components (e.g., less than 5% or less than 1%). For purposes of determining the amount of natural base oil, the amount of natural base oils present as diluent oils normally present in the various additives is to be taken into account. These materials can typically contribute 5 to 10 percent or more of oil to the overall composition.

A second component of the lubricant of the present invention is a dispersant viscosity index modifier. Multifunctional additives that provide both viscosity improving properties and dispersant properties are known in the art and are commercially available. Such products are described in numerous publications including Dieter Klamann, "Lubricants and Related Products", Verlag Chemie Gmbh (1984), pp 185–193; C. V. Smalheer and R. K. Smith "Lubricant Additives", Lezius-Hiles Co. (1967); M. W. Ranney, "Lubricant Additives", Noyes Data Corp. (1973), pp 92–145, M. W. Ranney, "Lubricant Additives, Recent Developments", Noyes Data Corp (1978), pp 139–164; M. W. Ranney, "Synthetic Oils and Additives for Lubricants", Noyes Data Corp. (1980), pp 96–166; and the above-identified U.S. Pat. No. 5,719,107.

Dispersant viscosity index modifiers are generally one or a mixture of polymers which perform several functions. They serve first as a viscosity index ("VI") modifier, sometimes referred to as a viscosity index improver. This is the well-known function of controlling the rate or amount of viscosity change of a lubricant as a function of temperature. These are materials which have comparatively little thickening effect at low temperatures but significant thickening at high temperatures. This behavior extends the temperature range over which a lubricant can be used.

The VI modifiers for which the present invention is particularly useful further contain functional groups which provide dispersant functionality (and sometimes other functionality, such as antioxidation properties) to the lubricant composition. Dispersant functionality serves to prevent particulate contamination in an oil or other lubricant from agglomerating into larger particles which can settle out as sludge or varnish. Although separate dispersant additives can also be used in the present invention, the presence of one or more comonomers on the VI modifier entity which serve this function is desirable.

The dispersant viscosity index modifiers can be functionalized versions of polymers which are generally used as viscosity index modifiers. Among the common classes of such polymers are olefin copolymers and acrylate or methacrylate copolymers.

Functionalized olefin copolymers can be, for instance, interpolymers of ethylene and propylene which are grafted with an active monomer such as maleic anhydride and then derivatized with an alcohol or an amine, as described in U.S. Pat. No. 4,089,794. Other such copolymers are copolymers of ethylene and propylene which are reacted or grafted with nitrogen compounds, as described in U.S. Pat. No. 4,068,056. Vinyl pyridine, N-vinyl pyrrolidone and N,N'-dimethylaminoethyl methacrylate are examples of typical nitrogen-containing monomers.

Derivatives of polyacrylate esters are well-known as dispersant viscosity index modifier additives. Dispersant acrylate or polymethacrylate viscosity modifiers such as Acryloid™ 985, Viscoplex™ 6-054, or Viscoplex™ 2-500, from RohMax, or LZ® 7720C, from The Lubrizol Corporation, are particularly useful.

The amount of the dispersant viscosity modifier should be an amount suitable to provide a desirable overall viscosity index as well as to impart dispersancy to the formulation. The desired degree of dispersancy (which can also be provided in part by conventional dispersants) is that which will permit the oil formulation to meet the requirements of soot handling, such as that measured in the Mack T8-E test for Mack EO-M+ specification, while maintaining good piston cleanliness and seal compatibility, in accordance with the Mercedes Benz 228.5 specifications. The amount of the dispersant viscosity modifier is typically 0.5 to 3 weight percent of the lubricant, such as 1 to 2 percent by weight, or 0.3 to 1.6 percent by weight.

The final required component of the present invention is a sulfur-free functionalized alkyl phenol detergent. Detergents in general are extremely well known additives for engine oil lubricants. They are generally salts of organic acids, which are often overbased. Metal overbased salts of organic acids are widely known to those of skill in the art and generally include metal salts wherein the amount of metal present exceeds the stoichiometric amount. Such salts are said to have conversion levels in excess of 100% (i.e., they comprise more than 100% of the theoretical amount of metal needed to convert the acid to its "normal" or "neutral" salt). They are commonly referred to as overbased, hyperbased or superbased salts and are usually salts of organic sulfur acids, organic phosphorus acids, carboxylic acids, phenols or mixtures of these.

The terminology "metal ratio" is used to designate the ratio of the total chemical equivalents of the metal in the overbased salt to the chemical equivalents of the metal in the salt which would be expected to result in the reaction between the organic acid to be overbased and the basic reacting metal compound according to the known chemical reactivity and stoichiometry of the two reactants. Thus, in a normal or neutral salt the metal ratio is one and, in an overbased salt, the metal ratio is greater than one. The overbased salts usually have metal ratios of at least 1.1:1. Typically they have ratios of 2:1 or 3:1 to 40:1. Salts having ratios of 12:1 to 20:1 are often used.

The basically reacting metal compounds used to make the overbased salts are usually an alkali or alkaline earth metal compound (i.e., the Group IA, IIA, and IIB metals, but normally excluding francium and radium and typically also excluding rubidium, cesium and beryllium), although other basically reacting metal compounds can be used. Compounds of Ca, Ba, Mg, Na and Li, such as their hydroxides and alkoxides of lower alkanols are usually used as basic metal compounds in preparing these overbased salts but others can be used as shown by the prior art referred to herein. Overbased salts containing a mixture of ions of two or more of these metals can be used in the present invention.

Overbased materials are generally prepared by reacting an acidic material (typically an inorganic acid or lower carboxylic acid, such as carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. The acidic organic compound will, in the present instance, be the functionalized alkyl phenol.

The acidic material used in preparing the overbased material can be a liquid such as formic acid, acetic acid, nitric acid, or sulfuric acid. Acetic acid is particularly useful. Inorganic acidic materials can also be used, such as HCl, $SO_2$, $SO_3$, $CO_2$, or $H_2S$, and in one embodiment, $CO_2$ or mixtures thereof, e.g., mixtures of $CO_2$ and acetic acid.

A promoter is a chemical employed to facilitate the incorporation of metal into the basic metal compositions. The promoters are diverse and are well known in the art and includes lower alcohols. A discussion of suitable promoters is found in U.S. Pat. Nos. 2,777,874, 2,695,910, and 2,616,904. Patents specifically describing techniques for making basic salts of acidic organic compounds generally include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

The detergents useful in the present invention are sulfur-free functionalized alkyl phenol detergents (phenates). The use of the terms "phenol" and "phenate" is not intended to imply that the aromatic moiety is limited to alkyl phenol per se, that is, a single benzene ring substituted with an OH group and an alkyl group, although, in fact, this is a particularly useful species upon which the substituted phenol is constructed. Other aromatic species which are encompassed within the scope of the present invention include those containing more than one OH group, such as catechols; phenolic species containing multiple alkyl or hydrocarbyl substituents; multiple ring structures including fused ring structures, comprising both unsaturated fused rings (e.g., naphthalene-based) and saturated rings (e.g., tetrahydronaphthalene); and non-condensed multiple ring structures including phenyl substitution and phenylalkyl substitution.

The functionalization of the alkyl phenol can comprise the addition of any functional group to the phenolic compound, other than an additional hydroxy group or an additional hydrocarbyl group, at least one such alkyl or hydrocarbyl group already being present in sufficient amount to provide oil solubility to the detergent. Typical functional groups include t-butyl groups, methylene coupling groups, ester-substituted alkyl groups, and aldehyde groups. In one embodiment the functionalization is by addition of carboxy functionality, in which case the detergent can be an alkyl salicylate or a derivative thereof. Salicylate detergents are well known; see, for instance, U.S. Pat. Nos. 5,688,751 or 4,627,928. In another embodiment, the substituent can be based on a glyoxylic acid condensation. Glyoxylic acid itself is HC(=O)—$CO_2$H; related ketones of the structure $R^1$C(=O)—$CO_2$H are also contemplated; thus $R^1$ can be hydrogen or a hydrocarbyl group of, for instance, 1 to 20 carbon atoms. A typical glyoxylate condensation product is

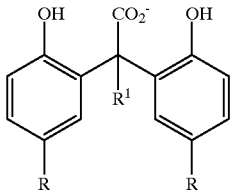

shown here as an anionic species, which will typically be neutralized with a metal salt. In this structure, the R groups are alkyl groups. The material shown would be the condensation of 2 moles of alkyl phenol with 1 mole of glyoxylic acid or derivative thereof. Other molar ratios are also possible; when a 1:1 ratio is approached, the condensation product becomes oligomeric or polymeric. These materials and methods for their preparation are disclosed in greater detail in U.S. Pat. No. 5,356,546.

In other embodiments the functionalized alkyl phenol can be a condensation product of the alkyl phenol with formaldehyde or other lower aldehydes. The acidic substituent, in this case, would be considered to be the one or more additional phenolic groups. The simplest such condensation product would be

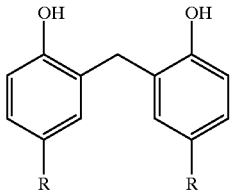

shown here as the 2:1 molar condensate of phenol:formaldehyde. Also, depending on the conditions of reaction, the formaldehyde unit may appear in other oxidation states. As in the case of glyoxylates, oligomeric structures can be formed when the molar ratio of formaldehyde:phenol increases. Examples of such type of oligomeric species are the calixarates, which are cyclic materials containing 4 to 8 phenol-formaldehye repeat units. Calixarates and methods of their preparation are disclosed in greater detail in U.S. Pat. No. 5,114,601. As will be apparent, mixtures of formaldehyde, other aldehydes, and glyoxylic acid can also be employed in such condensation reactions.

One category of functionalized derivatives of alkyl phenols, however, are certain saligenen derivatives. Saligenin itself, also known as salicyl alcohol and o-hydroxybenzyl alcohol, is represented by the structure

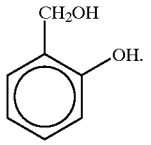

Useful saligenin derivatives include certain metal saligenin derivative which function as detergents. When the metal is magnesium, these compounds can be represented by the formula

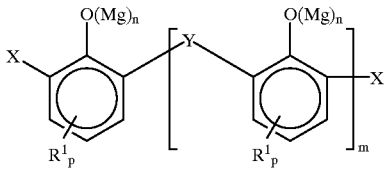

This represents generally a metal salt, such as a magnesium salt, of a compound containing one aromatic ring or a multiplicity of aromatic rings linked by "Y" groups, and also containing "X" groups. (Mg) represents a valence of a magnesium ion, and n, in each instance, is 0 or 1. (When n is zero the Mg is typically replaced by H to form an —OH group.) The value for "m" is typically 0 to 10, so number of such rings will be 1 to 11, although it is to be understood that the upper limit of "m" is not a critical variable. In one embodiment m is 2 to 9, such as 3 to 8 or 4 to 6. Other metals include alkali metals such as lithium, sodium, or potassium; alkaline earth metals such as calcium or barium; and other metals such as copper, zinc, and tin.

Most of the rings contain at least one $R^1$ substituent, which is the aforementioned hydrocarbyl group, such as alkyl group. $R^1$ can contain 1 to 60 carbon atoms, such as 7 to 28 carbon atoms or 9 to 18 carbon atoms. Of course it is understood that $R^1$ will normally comprise a mixture of various chain lengths, so that the foregoing numbers will normally represent an average number of carbon atoms in the $R^1$ groups (number average). Each ring in the structure will be substituted with 0, 1, 2, or 3 such $R^1$ groups (that is, p is 0, 1, 2, or 3), most typically 1, and of course different rings in a given molecule may contain different numbers of such substituents. At least one aromatic ring in the molecule must contain at least one $R^1$ group, and the total number of carbon atoms in all the $R^1$ groups in the molecule should be at least 7, such as at least 12.

In the above structure the X and Y groups may be seen as groups derived from formaldehyde or a formaldehyde source, by condensative reaction with the aromatic molecule. The relative amounts of the various X and Y groups depends to a certain extent on the conditions of synthesis of the molecules. While various species of X and Y may be present in the molecules in question, the commonest species comprising X are —CHO (aldehyde functionality) and —$CH_2OH$ (hydroxymethyl functionality); similarly the commonest species comprising Y are —$CH_2$— (methylene bridge) and —$CH_2OCH_2$— (ether bridge). The relative molar amounts of these species in a sample of the above material can be determined by $^1H/^{13}C$ NMR as each carbon and hydrogen nucleus has a distinctive environment and produces a distinctive signal. (The signal for the ether linkage, —$CH_2OCH_2$— must be corrected for the presence of two carbon atoms, in order to arrive at a correct calculation of the molar amount of this material. Such a correction is well within the abilities of the person skilled in the art.)

In one embodiment, X is at least in part —CHO and such —CHO groups comprise at least 10, 12, or 15 mole percent of the X and Y groups. In another embodiment the —CHO groups comprise 20 to 60 mole percent of the X and Y groups, such as 25 to 40 mole percent of the X and Y groups.

In another embodiment, X is at least in part —$CH_2OH$ and such —$CH_2OH$ groups comprise 10 to 50 mole percent of the X and Y groups, such as 15 to 30 mole percent of the X and Y groups.

In an embodiment in which m is non-zero, Y is at least in part —$CH_2$— and such —$CH_2$— groups comprise 10 to 55 mole percent of the X and Y groups, such as 25 to 45 or 32 to 45 mole percent of the X and Y groups.

In another embodiment Y is at least in part —$CH_2OCH_2$— and such —$CH_2OCH_2$— groups comprise 5 to 20 mole percent of the X and Y groups, such as 10 to 16 mole percent of the X and Y groups.

The above-described compound is, as mentioned, typically a magnesium salt and, indeed, the presence of magnesium during the preparation of the condensed product is believed to be useful in achieving the desired ratios of X and Y components described above. The number of Mg ions in the compound is characterized by an average value of "n" of 0.1 to 1 throughout the composition, such as 0.2 or 0.3 to 0.4 or 0.5, or 0.35 to 0.45. Since Mg is normally a divalent ion, when all of the phenolic structures shown are entirely neutralized by $Mg^{+2}$ ions, the average value of n in the composition will be 0.5, that is, each Mg ion neutralizes 2 phenolic hydroxy groups. Those two hydroxy groups may be on the same or on different molecules. If the value of n is less than 0.5, this indicates that the hydroxy groups are less than completely neutralized by Mg ions. If the value of n is greater than 0.5, this indicates that a portion of the valence of the Mg ions is satisfied by an anion other than the phenolic structure shown. For example each Mg ion could be associated with one phenolic anion and one hydroxy ($OH^-$) ion, to provide an n value of 1.0. The specification that n is 0.1 to 1.0 is not directly applicable to overbased versions of this material (described below and also a part of the present invention) in which an excess of Mg or another metal can be present.

It is understood that in a sample of a large number of molecules, some individual molecules may exist which deviate from these parameters, for instance, there may be some molecules containing no $R^1$ groups whatsoever. These molecules could be considered as impurities, and their presence will not negate the present invention so long as the majority (and generally the substantial majority) of the molecules of the composition are as described.

The above-described component can be prepared by combining a phenol substituted by the above-described $R^1$ group with formaldehyde or a source of formaldehyde and magnesium oxide or magnesium hydroxide under reactive conditions, in the presence of a catalytic amount of a strong base. Common reactive equivalents of formaldehyde includes paraformaldehyde, trixoane, formalin and methal. For convenience, paraformaldehyde is can be used.

The relative molar amounts of the substituted phenol and the formaldehyde can be important in providing products with the desired structure and properties. In a typical embodiment, the substituted phenol and formaldehyde are reacted in equivalent ratios of 1:1 to 1:3 or 1.4, such as 1:1.1 to 1:2.9 or 1:1.4 to 1:2.6, or 1:1.7 to 1:2.3. Thus in one embodiment there will be about a 2:1 equivalent excess of formaldehyde. (One equivalent of formaldehyde is considered to correspond to one $H_2CO$ unit; one equivalent of phenol is considered to be one mole of phenol.)

The strong base is can be sodium hydroxide or potassium hydroxide, and can be supplied in an aqueous solution.

The process can be conducted by combining the above components with an appropriate amount of magnesium oxide or magnesium hydroxide with heating and stirring. A diluent such as mineral oil or other diluent oil can be included to provide for suitable mobility of the components. An additional solvent such as an alcohol can be included if desired, although it is believed that the reaction may proceed more efficiently in the absence of additional solvent. The reaction can be conducted at room temperature or at a slightly elevated temperature such as 35–120° C., 70–110° C., or 90–100° C., and of course the temperature can be increased in stages. When water is present in the reaction mixture it is convenient to maintain the mixture at or below the normal boiling point of water. After reaction for a suitable time (e.g., 30 minutes to 5 hours or 1 to 3 hours) the mixture can be heated to a higher temperature, typically under reduced pressure, to strip off volatile materials. Favorable results are obtained when the final temperature of this stripping step is 100 to about 150° C., such as 120 to about 145° C.

Reaction under the conditions described above typically leads to a product which has a relatively high content of —CHO substituent groups, that is, 10%, 12%, and even 15% and greater. Such materials, when used as detergents in lubricating compositions, exhibit good upper piston cleanliness performance, low Cu/Pb corrosion, and good compatibility with seals. Use of metals other than magnesium in the synthesis typically leads to a reduction in the content of —CHO substituent groups.

Example 1

To a 5-L, 4-necked round bottom flask equipped with stirrer, stopper, thermowell, and reflux condenser, the following are charged: 670 g diluent oil (mineral oil), 1000 g dodecyl phenol, and a solution of 3 g NaOH in 40 g water. The mixture is heated to 35° C. with stirring (350 r.p.m.). When 35° C. is attained, 252 g of paraformaldehyde (90%) are added to the mixture and stirring is continued. After 5 minutes, 5 g of MgO and 102 g of additional diluent oil are added. The mixture is heated to 79° C. and held at temperature for 30 minutes. A second increment of 58 g MgO is added and the batch further heated and maintained at 95–100° C. for 1 hour. Thereafter the mixture is heated to 120° C. under a flow of nitrogen at 28 L/hr (1.0 std. $ft^3$/hr.). When 120° C. is reached, 252 g diluent oil is added, and the mixtures is stripped for 1 hour at a pressure of 2.7 kPa (20 torr) at 120° C. for 1 hour and then filtered.

The resulting product is analyzed and contains 1.5% by weight magnesium and has a Total Base Number (TBN) of 63. Analysis of the product by 1D and 2D $^1H/^{13}C$ NMR reveals an aldehyde content of 29 mole %, a methylene bridge content of 38 mole %, an ether bridge content of 12 mole %, and a hydroxymethyl content of 21 mole %.

The material prepared by the above process can be further treated by boration or by overbasing. Borated compositions are prepared by reaction of the above-described saligenin derivative one or more boron compounds. Suitable boron compounds include boric acid, borate esters, and alkali or mixed alkali metal and alkaline earth metal borates. These metal borates are generally a hydrated particulate metal borate and they, as well as the other borating agents, are known in the art and are available commercially. Typically the saligenin derivative is heated with boric acid at 50–100° C.

The material can also be overbased. Overbased salts of organic acids generally, and methods of their synthesis, have been described above and are widely known to those of skill in the art. The magnesium saligenin derivative can be overbased using additional Mg metal or using a different metal.

Example 2

Mg Saligenin Derivative Overbased with Ca

Into a 2 L four-necked flask equipped with stirrer, thermowell, reflux condenser, and a subsurface tube, is charged 1000 g of the product of Example 2 (Mg saligenin derivative in diluent oil), 50 g of a mixture of isobutyl and amyl alcohols, 100 g of methanol, and 74 g of $Ca(OH)_2$. A solution of 1 g acetic acid in 4 g water is added to the flask and the contents are held, with stirring, at 44° C. for 30 minutes. Carbon dioxide is blown through the mixture for 1 hour or longer, at 14 L/hr (0.5 std. $ft^3$/hr.) until a direct base number of 15 is obtained. The mixture is heated to 120° C. under a nitrogen flow of 28 L/hr (1.0 std. $ft^3$/hr.) for 1 hour, to strip volatiles. The resulting mixture is filtered and determined to have a TBN of 142 and to contain 3% Ca and 1.4% Mg by weight. NMR analysis reveals 30% aldehyde functionality, 39% methylene coupling, 17% ether coupling, and 14% hydroxymethyl functionality.

Example 3

Mg Overbased Saligenin Derivative

Into a 2-liter, four-necked flask equipped with stirrer, thermowell, reflux condenser, and subsurface tube, is charged 1000 g of the product of example 2, 50 g of a mixture of isobutyl and amyl alcohols, and 63 g MgO. The mixture is heated, with stirring, to 50° C. A solution of 130 g of stearic acid and 100 g of diluent oil is added. The mixture is heated to 70° C. and held at this temperature for 3 hours. The mixture was cooled to 60° C. To the mixture, 100 g of methanol and 7 g acetic acid are added. Carbon dioxide is blown through the mixture for over 3 hours at 28 L/hr (0.5 std. $ft^3$/hr) until a direct base number of less than 5 is obtained for the mixture. The mixture is stripped to 120° C. under a carbon dioxide flow of 28 L/hr (0.5 std. $ft^3$/hr) and held at this temperature for 1 hour under nitrogen flow at 14 L/hr (0.5 std. $ft^3$/hr). The product is filtered and determined to have a TBN of 130 and to contain 2.8 weight % magnesium. Analysis reveals 32% aldehyde functionality, 41% methylene coupling, 12% ether coupling, and 15% hydroxymethyl functionality.

The detergents generally can also be borated by treatment with a borating agent such as boric acid. Typical conditions include heating the detergent with boric acid at 100 to 150° C., the number of equivalents of boric acid being roughly equal to the number of equivalents of metal in the salt. U.S. Pat. No. 3,929,650 discloses borated complexes and their preparation.

These and other saligenin-derived detergents and examples of their preparation are described in detail in U.S. Provisional Application Ser. No. 60/194136, filed Apr. 3, 2000.

The functionalized hydrocarbyl-substituted phenol detergent should be sulfur free. This requirement excludes all but small, incidental amounts of sulfur introduced as, for instance, small amounts of linking or bridging groups, or in the form of sulfonic acid groups. These are not substantially sulfurized materials. The presence of sulfur in the phenol detergent is generally undesirable because it can lead to decreased compatibility with diesel aftertreament devices and worsened corrosion. The amount of S present in the phenol detergent is typically less than 0.5% by weight, such as less than 0.25%, or less than 0.1%, or even completely sulfur free.

The amount of the detergent component in a completely formulated lubricant will depend, to some extent, on the specific detergent which is selected. For the saligenin derivatives described above, the amount will typically be 0.5 to 4 percent by weight of the lubricant composition, such as 1 to 2 or 3 percent by weight, or 1.2 to 1.7 percent by weight. Its concentration in a concentrate will be correspondingly increased, to, e.g., 5 to 65 weight percent.

Other additives or agents can be employed in compositions of the present invention, including antioxidants. Common antioxidants include alkyl phenols, especially hindered alkyl phenols. A favored structure, when the alkyl groups are t-butyl groups, is represented by the following formula:

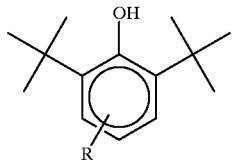

(where R is one or more further optional substituents).

Other antioxidants include aromatic amines. In one embodiment, the antioxidant comprises an alkylated diphenylamine such as nonylated diphenylamine:

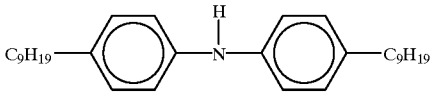

Other optional components include corrosion inhibitors and rust inhibitors such as various acid-containing compounds. Other optional components are extreme pressure and anti-wear agents, which include chlorinated aliphatic hydrocarbons, boron-containing compounds including borate esters and molyb-denum compounds. Well known classes of antiwear agents include zinc dialkyldithiophosphates and dithiocarbamates.

Detergents other than the sulfur-free functionalized hydrocarbyl-substituted phenol detergent can also be included. Such other detergents are extremely well known and will be based on other acidic materials such as sulfonic acids, carboxylic acids, phosphorus acids, and other phenolic materials. Such detergents have been described in detail in numerous references, including U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. In certain embodiments of the present invention, the lubricant will also contain a calcium phenate detergent or a calcium sulfonate detergent, or both.

Other viscosity improvers, beside the dispersant viscosity improvers described above, can also be present. They include polyisobutenes, polymethacrylate acid esters, polyacrylate acid esters, hydrogenated diene polymers, polyalkyl styrenes, hydrogenated alkenyl aryl conjugated diene copolymers, and polyolefins.

Pour point depressants are a particularly useful type of additive sometimes included in the lubricating oils described herein. See for example, page 8 of "Lubricant Additives" by C. V. Smalheer and R. Kennedy Smith (Lesius-Hiles Company Publishers, Cleveland, Ohio, 1967).

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

These and other additives are described in greater detail in U.S. Pat. No. 4,582,618 (column 14, line 52 through column 17, line 16, inclusive).

In certain embodiments of the present invention it is desirable to provide a lubricant composition containing a very low amount of chlorine, due to environmental concerns. Such lubricants can contain less than 50 parts per million, or less than 40 parts per million chlorine, or even lower amounts. Chlorine is often introduced into lubricants along with one or more additive components which may have been prepared using chlorine during the manufacturing process. Removal of residual amounts of chlorine from the additive may be less than complete. Recently various approaches have been reported for preparing dispersants and other products with very low chlorine levels. Among those which may be suitable for preparing dispersants for use in the present compositions are those disclosed in U.S. Pat. No. 6,077,909 and references cited therein.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, or no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent)

can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

EXAMPLES

Example 4

A lubricant formulation is prepared containing the following components:

| | |
|---|---|
| Synthetic poly-α-olefin, mixture of 4 and 6 × $10^{-6}m^2/s$ (cSt) materials, overall > 5 × $10^{-6}m^2/s$ (cSt) | 56.0 |
| High viscosity index synthetic monoester | 10.0 |
| $C_{10-13}$ alkyl-substituted benzene | 12.0 |
| Polymethacrylate dispersant viscosity modifier | 1.4 |
| Olefin polymer viscosity modifier | 0.2 |
| Dispersant(s) | 5.9 |
| Zinc alkyl dithiophosphate | 1.2 |
| Mg saligenin-derivative detergent, 70 TBN Mg | 1.4 |
| Ca sulfonate detergent(s) | 1.7 |
| Ca phenate detergent(s) | 0.8 |
| Other conventional components | 1.1 |
| Diluent oil(s) | balance |

Example 5

A lubricant formulation is prepared containing the following components:

| | |
|---|---|
| Synthetic poly-α-olefin, 6 × $10^{-6}m^2/s$ (cSt) | 43.6 |
| High viscosity index synthetic monoester | 20.0 |
| $C_{10-13}$ alkyl-substituted benzene | 15.0 |
| Polymethacrylate dispersant viscosity modifier | 1.2 |
| Olefin polymer viscosity modifier | 0.2 |
| Dispersant(s) | 5.7 |
| Zinc alkyl dithiophosphate | 1.2 |
| Mg saligenin-derivative detergent, 70 TBN Mg | 1.4 |
| Ca sulfonate detergent(s) | 1.7 |
| Ca phenate detergent(s) | 0.8 |
| Other conventional components | 1.3 |
| Diluent oil(s) | balance |

Examples 6–10

Several examples are prepared and evaluated for their wear performance. A modified version of the CH-4 Cummins M-11 engine test is used to determine heavy duty diesel valve train wear performance. The CH-4 Cummins M-11 is a turbocharged in-line 6-cylinder, 11 L engine. The engine test duration is 200 hours, which is divided into four 50-hour stages. During the first and third stage, the engine is overfueled and is operated with retarded timing to generate excessive soot, such that the reference oil and test oil produce more than 5% and 4.5% soot, respectively, at 150 hours. The second and fourth stages are run at lower speed and higher torque, to induce wear. The test used is modified somewhat to provide a shorter duration test with more severe conditions. The results of the test are presented in terms of mg weight loss due to wear at the crossheads.

Normal criteria for passing this test include an average weight loss of 6.5 mg or less at 4.5% soot.

| Example: | 6(C) | 7 | 8 | 9 | 10 | 11 |
|---|---|---|---|---|---|---|
| Base Oils, overall visc., $10^{-6}m^2/s$ (cSt): | 5.84 | 5.83 | 5.83 | 5.83 | 5.46 | 5.78 |
| Synthetic poly-α-olefin, % | 75.5 | 72.7 | 44.75 | 43.65 | 56 | 56 |
| Synthetic monoester, % | 5 | 5 | 20 | 20 | 10 | 10 |
| Alkylated benzene, % | — | — | 15 | 15 | 12 | 12 |
| Polymethacrylate dispersant-viscosity modifier, % | — | 1.0 | 1.25 | 1.25 | 1.42 | 1.42 |
| Olefin polymer viscosity modifier, % | 0.5 | 0.2 | 0.15 | 0.15 | 0.2 | 0.2 |
| Dispersant(s) (other), % | 5.68 | 5.68 | 5.65 | 5.65 | 6.53 | 5.9 |
| Zinc alkyl dithiophosphate, % | 1.11 | 1.11 | 1.2 | 1.2 | 1.2 | 1.2 |
| Mg Saligenin derivative detergents, 70 TBN, % | 1.47 | 1.70 | — | 1.4 | 1.4 | 1.4 |
| Ca Sulfonate detergent(s), % | 1.63 | 1.88 | 1.7 | 1.7 | 1.7 | 1.7 |
| Ca Phenate detergent(s), % | 0.61 | 1.46 | 1.92 | 0.8 | 0.8 | 0.8 |
| Fatty friction modifier, % | — | — | 0.41 | 0.41 | — | — |
| Other conventional compounds, % | 1.1 | 1.1 | 1.1 | 1.1 | 1.1 | 1.1 |
| Diluent oil(s), % | bal. | bal. | bal. | bal. | bal. | bal. |
| % Sulfated ash (ASTM D-874) | 1.65 | 1.90 | 1.60 | 1.60 | 1.60 | 1.60 |
| M-11 Weight Loss, mg | 6.30 | 4.60 | 12.5 | 10.8 | n.d. | 5.70 |

n.d. = not determined

Example 6 is a comparative ("C") example in that it does not contain a dispersant viscosity modifier. While it formally passes the modified Cummins M-11 test, it (as well as the material of Example 7, but unlike the material of Example 10) may not be fully satisfactory in single engine deposit tests designed for low emission engines. Examples 6 and 7 may be compared, however, and it is observed that Example 7 provides significantly improved antiwear performance on the modified Cummins M-11 test. This improvement is observed even though Example 7 has a significantly higher sulfated ash content, a feature which is known to correlate with diminished antiwear performance.

Examination of Examples 8 and 9 illustrates an advantage of another aspect of the present invention. In Example 9 a significant proportion of the detergent is the overbased magnesium saligenin derivative, while in Example 8 the Mg saligenin salt is not present, although a calcium phenate salt is present. The wear results for Example 9 are significantly improved compared with Example 8, illustrating the benefit of using the overbased magnesium saligenin compound. It is noted that the wear performance of these two examples is diminished compared to that of some of the other materials, presumably due to the presence of the fatty friction modifier.

Example 11, which does not contain the fatty friction modifier, shows excellent antiwear performance

Examples 12–17

Emissions Data

Emissions are tested in a Variable Temperature Emissions Chamber (VTEC) which enables chassis dynamometer emissions testing at any ambient temperature between −30° C. to +50° C. Testing is conducted using standard equipment and procedures applicable to heavy duty vehicle testing. Exhaust gases are sampled via a full flow Constant Volume Sample (CVS) system using the Critical Flow Venturi (CFV) operation principle. In addition to standard "bag" emissions results, raw modal gas samples from the tailpipe of each vehicle are analyzed. Tailpipe emissions are recorded at 10 Hz and averaged to second-by-second data to give a real time trace of emissions throughout the test. This method allows detailed analysis of the emissions and vehicle operation to be conducted during the test cycles.

The so-called FIGE cycle is selected, which is considered to be the most representative European all-round cycle for general truck operations. The FIGE cycle is a real world test cycle which was developed from a study of 17 different goods vehicles from small delivery vans to 40 ton articulated vehicles and 3 local public transport buses. From the study a transient driven test cycle was developed in order to allow emission levels to be determined under dynamic operating conditions.

The FIGE cycle consists of three distinct operating phases:

1. An urban cycle lasting 600 seconds with speeds up to 50 km/h.
2. A suburban cycle lasting 600 seconds with speeds up to 80 km/h.
3. A motorway cycle lasting 600 seconds with speeds up to 90 km/h.

Oil formulations are tested in two different vehicle types, both containing heavy duty diesel engine meeting Euro 2 emissions regulations. The engine is filled with the test oil and conditioned the evening before the test day, making it necessary only to warm the vehicle to an axle temperature of 75° C. before hot start tests. The test vehicle is warmed up for 25 minutes between tests or 40 minutes from a cold start, by running at 75 km/h in 8 L gear to allow the engine temperature to stabilize. Each vehicle is tested using the FIGE cycle three times on each oil. The ambient temperature is 22° C.

The results are reported as particulate emission over the course of the test (average of 3 runs), in units of g/km, the two results reported referring to the results from vehicles 1 and 2, respectively. Standard deviations for each measurement are shown in parentheses. The results are shown in the following Table:

| Ex. Test condition\oil | Natural[1] | Part-Synthetic[2] | Synthetic[3] |
|---|---|---|---|
| 12 Motorway | 0.102 (.004) | 0.089 (.002) | 0.056 (.004) |
| 13 " | 0.111 (.003) | 0.093 (.004) | 0.055 (.004) |
| 14 Urban | 0.342 (.012) | 0.277 (.007) | 0.121 (.012) |
| 15 " | 0.330 (.010) | 0.290 (.012) | 0.120 (.012) |
| 16 Suburban | 0.127 (.006) | 0.121 (.004) | 0.077 (.006) |
| 17 " | 0.142 (.005) | 0.125 (.006) | 0.091 (.007) |

[1](comparative) A 15W-40 formulation of 14% of a commercial additive package (which does not contain a sulfur-free functionalized hydrocarbyl-substituted phenol detergent) in 58% 145N mineral oil and 19% 600N mineral oil, with 8% non-dispersant olefin copolymer viscosity modifier and 0.2% pour point depressant.

[2](comparative) A 5W-30 formulation, identical to the previous, except prepared in 14.5% 145N mineral oil and 64.7% synthetic polyalpha olefin oil ($6 \times 10^{-6}$ $m^2/s$ (cSt)) with 6.5% of the same viscosity modifier and the same pour point depressant.

[3]The formulation of Example 4, above. (A 5W-30 formulation in Synthetic poly-α-olefin oil.)

The results illustrate the significant reduction in particulate emission obtained by using formulations based on synthetic base oils.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A lubricant suitable for use in a diesel engine, comprising:

(a) a synthetic base oil composition, said base oil overall having a kinematic viscosity of at least about $4.8\times10^{-6}$ $m^2/s$ (4.8 cSt) at 100° C. and a viscosity index of at least about 110;

(b) a dispersant-viscosity modifier; and (c) a sulfur-free functionalized hydrocarbyl-substituted phenol detergent which is a saligenin derivative represented by the formula

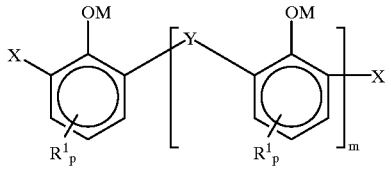

wherein X comprises —CHO or —$CH_2OH$, Y comprises —$CH_2$— or —$CH_2OCH_2$—, and wherein such —CHO groups comprise at least about 10 mole percent of the X and Y groups; M is hydrogen, ammonium, or a valence of a metal ion, $R^1$ is a hydrocarbyl group containing 1 to about 60 carbon atoms, m is 0 to about 10, and each p is independently 0, 1, 2, or 3, provided that at least one aromatic ring contains an $R^1$ substituent and that the total number of carbon atoms in all $R^1$ groups is at least 7.

2. The lubricant of claim 1 wherein said synthetic base oil composition comprises a polyalphaolefin oil, a synthetic ester, an alkylbenzene, or mixtures thereof.

3. The lubricant of claim 2 wherein the synthetic base oil composition comprises a mixture of at least one polyalphaolefin of about 4 to about $8\times10^{-6}$ $m^2/s$ (4–8 cSt) viscosity at 100° C., at least one $C_{10-13}$ alkyl-substituted benzene, and optionally at least one synthetic monoester.

4. The lubricant of claim 3 wherein the synthetic base oil composition comprises about 60 to about 95 percent by weight polyalphaolefin, about 5 to about 20 percent by weight $C_{10-13}$ alkyl-substituted benzene, and 0 to about 20 percent by weight synthetic monoester.

5. The lubricant of claim 1 wherein the synthetic base oil composition has a viscosity of about 5.1 to about $7.0\times10^{-6}$ $m^2/s$ (5.1–7.0 cSt) at 100° C.

6. The lubricant of claim 1 wherein the synthetic base oil composition comprises multiple components and any such components individually having viscosity indices of less than 120 comprise in total no more than about 20 percent by weight of said base oil composition.

7. The lubricant of claim 1 wherein the synthetic base oil composition has a viscosity index of about 120 to about 160.

8. The lubricant of claim 1 wherein the synthetic base oil composition contains 0 to about 25 percent by weight of one or more natural base oil components.

9. The lubricant of claim 1 wherein the dispersant viscosity modifier is a functionalized polymethacrylate or a functionalized olefin copolymer.

10. The lubricant of claim 1 wherein the dispersant viscosity modifier is a polymethacrylate functionalized with a nitrogen-containing monomer.

11. The lubricant of claim 1 wherein the amount of the dispersant viscosity modifier is about 0.5 to about 3 percent by weight of the lubricant.

12. The lubricant of claim 1 wherein the amount of the dispersant viscosity modifier is about 1 to about 2 percent by weight of the lubricant.

13. The lubricant of claim 1 wherein in (c), $R^1$ is an alkyl group containing about 9 to about 18 carbon atoms.

14. The lubricant of claim 1 wherein in (c), m is about 3 to about 8.

15. The lubricant of claim 1 wherein in (c) the —CHO groups comprise about 20 to about 60 mole percent of the X and Y groups.

16. The lubricant of claim 15 wherein M is calcium or magnesium.

17. The lubricant of claim 1 wherein the saligenin derivative of (c) is a magnesium saligenin derivative represented by the formula

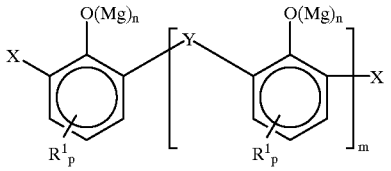

wherein n in each case is 0 or 1 and is on average at least about 0.1 in the composition.

18. The lubricant of claim 17 wherein n is about 0.3 to about 0.5.

19. The lubricant of claim 17 wherein the saligenin derivative is an overbased salt.

20. The lubricant of claim 1 wherein the amount of the saligenin derivative is about 0.5 to about 4 percent by weight of the lubricant.

21. The lubricant of claim 1 wherein the amount of the saligenin derivative is about 1.2 to about 1.7 percent by weight of the lubricant.

22. The lubricant of claim 1 further comprising at least one additive for diesel engine lubricants selected from the group consisting of dispersants, antiwear agents, detergents other than the sulfur-free functionalized alkyl phenol detergent of (c), and antioxidants.

23. The lubricant of claim 22 wherein said lubricant contains less than about 50 parts per million by weight of chlorine.

24. The lubricant of claim 22 wherein said lubricant contains less than about 40 parts per million by weight of chlorine.

25. The lubricant of claim 22 wherein said additive comprises a calcium phenate or a calcium sulfonate.

26. A lubricant prepared by admixing the components of claim 1.

27. A method for lubricating a crankcase-lubricated diesel engine comprising supplying the lubricant of claim 1 to the crankcase thereof.

28. A lubricant suitable for use in a diesel engine, comprising:

(a) a synthetic base oil composition, said base oil overall having a kinematic viscosity of at least about 4.8 cSt at 100° C. and a viscosity index of at least about 110;

(b) a dispersant-viscosity modifier; and (c) a sulfur-free functionalized hydrocarbyl-substituted phenol detergent, prepared by reacting a phenol substituted by a hydrocarbyl group containing 1 to 60 carbon atoms with formaldehyde or a source of formaldehyde and magnesium oxide or magnesium hydroxide in the presence of a catalytic amount of a strong base.

* * * * *